US006256961B1

(12) United States Patent
Byrnes

(10) Patent No.: US 6,256,961 B1
(45) Date of Patent: Jul. 10, 2001

(54) UTILITY POLE BASE CONSTRUCTION

(76) Inventor: Dennis S. Byrnes, 113 Yale Ave., Lancaster, PA (US) 17603

( * ) Notice: Subject to any disclaimer, the term of this patent is extended or adjusted under 35 U.S.C. 154(b) by 0 days.

(21) Appl. No.: 09/366,577

(22) Filed: Aug. 4, 1999

Related U.S. Application Data

(60) Provisional application No. 60/098,035, filed on Aug. 27, 1998.

(51) Int. Cl.[7] ..... E02D 27/42

(52) U.S. Cl. ..... 52/736.4; 52/170; 52/296; 248/345.1; 248/579; 362/431

(58) Field of Search ..... 52/170, 296, 723.2, 52/736.4, 737.5; 248/345.1, 579; 362/431

(56) References Cited

U.S. PATENT DOCUMENTS

| | | |
|---|---|---|
| Re. 16,494 | 12/1926 | Malone . |
| 121,165 | 11/1871 | Gouch . |
| 646,970 | 4/1900 | Francis . |
| 715,362 | 12/1902 | Etheridge . |
| 837,820 | 12/1906 | Folsom et al. . |
| 843,762 | 2/1907 | Müller . |
| 933,291 | 9/1909 | Cogswell . |
| 978,505 | 12/1910 | Stewart . |
| 985,605 | 2/1911 | Konopinski . |
| 985,681 | 2/1911 | Konopinski . |
| 1,080,525 | 4/1913 | Orr . |
| 1,419,108 | 6/1922 | Bitting . |
| 1,470,320 | 2/1923 | Bolander . |
| 1,497,822 | 6/1924 | Williams . |
| 1,593,330 | 7/1926 | De La Mare . |
| 1,596,657 | 8/1926 | Heber . |
| 1,598,592 | 8/1926 | Barrett . |
| 1,600,032 | 9/1926 | Barrick et al. . |
| 1,600,066 | 9/1926 | Rastetter . |
| 1,617,447 | 2/1927 | Johnston . |
| 1,696,934 | 1/1929 | Allen ..... 52/736.4 X |
| 1,732,690 | 10/1929 | Marsteller . |
| 1,834,535 | 12/1931 | Riemenschneider . |
| 1,882,228 | 11/1932 | Ne Page . |
| 1,891,736 | 12/1932 | Sporn . |
| 1,939,503 | 12/1933 | Wall . |
| 1,950,677 | 3/1934 | Hogan . |
| 2,090,972 | 8/1937 | Allen . |
| 2,897,553 | 8/1959 | Gorrow . |
| 3,193,059 | 7/1965 | Wallerstein, Jr. . |
| 3,305,990 | 2/1967 | Hägeby . |
| 3,321,160 | 5/1967 | Turnbull . |
| 3,325,950 | 6/1967 | Pfaff, Jr. . |
| 3,347,003 | 10/1967 | Lapp . |
| 3,364,635 | 1/1968 | Guggemos . |
| 3,381,427 | 5/1968 | Watson . |

(List continued on next page.)

FOREIGN PATENT DOCUMENTS

| | | |
|---|---|---|
| 48598 | 6/1911 | (AT) . |
| 122318 | 4/1931 | (AT) . |
| 46375 | 7/1909 | (CH) . |

(List continued on next page.)

*Primary Examiner*—Peter R. Brown
(74) *Attorney, Agent, or Firm*—Drinker Biddle & Reath LLP

(57) ABSTRACT

A base cover for a utility pole comprises a first base member and a second base member secured to one another to form a base unit to fit round the utility pole. The base unit has an opening at its upper end, the opening adapted to fit closely around the utility pole. A resilient gasket is formed adjacent the opening and is adapted to engage the pole and resist forced movement of the base unit up the pole. The gasket consists of two gasket members, one secured to each base member. The gasket member is a ring with a trunco-conical inner opening. The opening is narrowest at the top. The shape of the gasket allows sliding of the base unit down the utility pole, but resists sliding up the pole. The base unit is assembled at a convenient position along the pole, and slid down to its in-use position at ground level. The gasket prevents it from being lifted out of position without dismantling the two base members.

4 Claims, 3 Drawing Sheets

U.S. PATENT DOCUMENTS

| | | | | |
|---|---|---|---|---|
| 3,400,905 | | 9/1968 | Van Dusen, Jr. . | |
| 3,606,222 | | 9/1971 | Howard . | |
| 3,653,169 | | 4/1972 | Jenner . | |
| 3,671,738 | | 6/1972 | Beachley . | |
| 3,703,812 | | 11/1972 | Newton . | |
| 3,890,795 | | 6/1975 | Maurer . | |
| 3,894,375 | | 7/1975 | Lindberg, Jr. . | |
| 3,942,296 | | 3/1976 | Meyer . | |
| 4,079,559 | | 3/1978 | Tenbrummeler . | |
| 4,095,381 | | 6/1978 | Garchinsky . | |
| 4,200,906 | | 4/1980 | Santilli . | |
| 4,295,308 | | 10/1981 | Korfanta . | |
| 4,697,959 | | 10/1987 | Kinnan . | |
| 5,060,435 | | 10/1991 | Bogdanow . | |
| 5,369,925 | | 12/1994 | Vargo . | |
| 5,454,202 | | 10/1995 | van der Weijden . | |
| 5,571,229 | | 11/1996 | Fitzsimmons et al. . | |
| 5,634,482 | | 6/1997 | Martin . | |
| 5,704,580 | | 1/1998 | Peery, Jr. . | |
| 5,720,134 | | 2/1998 | Kurtz . | |
| 5,752,349 | | 5/1998 | Fitzsimmons et al. . | |
| 5,758,856 | | 6/1998 | Carnahan et al. . | |
| 5,832,675 | * | 11/1998 | Zuares | 52/736.4 X |
| 6,061,939 | * | 5/2000 | Gildea | 52/736.4 X |

FOREIGN PATENT DOCUMENTS

| | | |
|---|---|---|
| 2450064 | 4/1975 | (DE) . |
| 574337 | 7/1924 | (FR) . |
| 757954 | 1/1934 | (FR) . |
| 2 654 762 | 5/1991 | (FR) . |
| 2373/1895 | 2/1895 | (GB) . |
| 23761 | 12/1914 | (GB) . |

* cited by examiner

UTILITY POLE BASE CONSTRUCTION

This application claims benefit of Provisional application Ser. No. 60/098,035 filed Aug. 27, 1998.

FIELD OF THE INVENTION

The present invention relates to a base for a utility pole, such as a traffic light or street light. In particular, the invention relates to a base for a pole that is retained in position and resists sliding up the pole.

BACKGROUND OF THE INVENTION

In FIG. 1, there is shown one half 10 of a base for a utility pole 12, such as a traffic light or street light. Typically, the pole is mounted in concrete (not shown) with electrical source or light control wires (not shown) being fed from underground. The electrical connection between the source wires or control wires and the light fixture is made close to the bottom of the pole. A two part base is used to cover the wire connection and, among other things, to create a pleasing appearance.

As shown in FIG. 2, one half or member 10 of the split base is mounted opposite of another split base member 10, and they are joined together to make a single base unit. The top surfaces of a split base member 10 are shown in FIG. 3.

One problem that may occur with respect to the split base is that vandals attempt to remove or move the base, exposing the electrical connections. In the past, the opening 14 at the top of the completed base unit is larger than the outside diameter of the pole 12. Thus, the base unit can be slid upwardly without removal of screws (not shown) that hold the base members 10 together.

BRIEF SUMMARY OF THE INVENTION

According to one aspect of the invention, there is provided a base cover for a utility pole, comprising a first base member and a second base member, each comprising one half of a base unit. The first and second base members are secured to one another to form the base unit. The base unit has an opening at its upper end, the opening adapted to wrap around a utility pole. A resilient gasket is provided adjacent the opening. The gasket is adapted to engage the pole upon assembly of the base unit and resist forced movement of the base unit up the pole.

According to another aspect of the invention, there is provided a method of covering the base of a utility pole, which includes providing a first base member and a second base member. The base members are each adapted to form one half of a base unit having an opening at its upper end. The opening is adapted to wrap around a utility pole. Each of the base members has a resilient gasket member adjacent the opening. The gasket members are adapted to form, upon assembly of the base unit, a gasket that engages the pole and resists forced movement of the base unit up the pole. The base members are positioned on opposite sides of a utility pole such that the opening wraps around the utility pole and the resilient gasket engages the utility pole. The first and second base members are secured to one another to form a base unit. The base unit is slid down the utility pole to a desired position. The gasket resists sliding of the base unit out of position up the pole.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
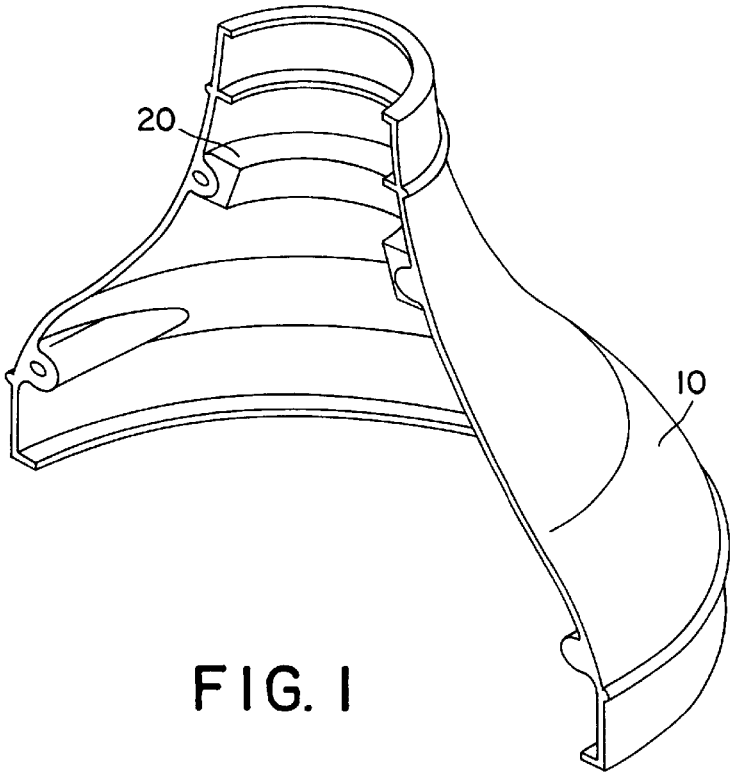
FIG. 1 shows one half or member of a first embodiment of a split base for a utility pole as is contemplated by the present invention.
Figure 2:
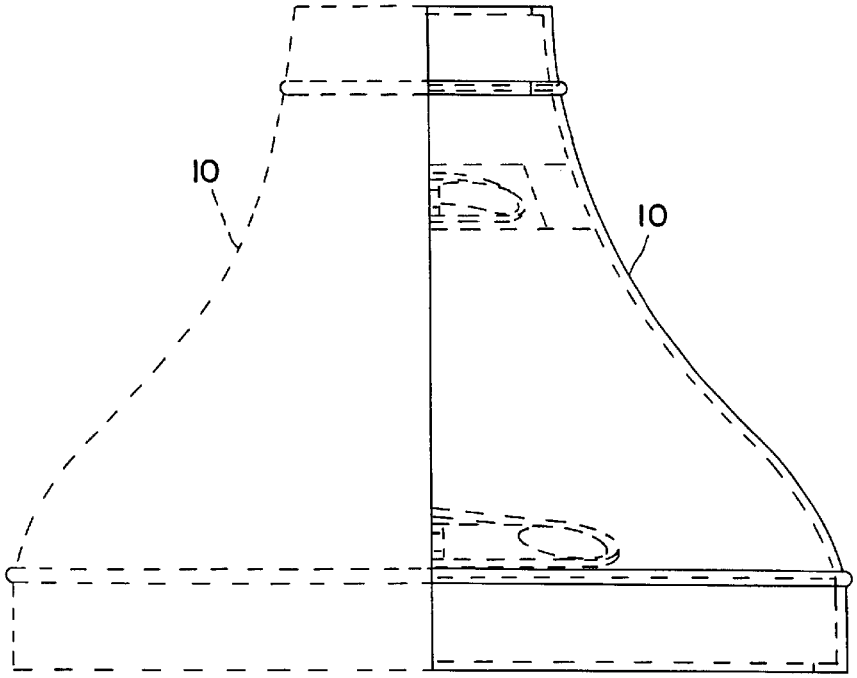
FIG. 2 shows a side view of the base member in FIG. 1 and the corresponding base member in phantom.
Figure 3:
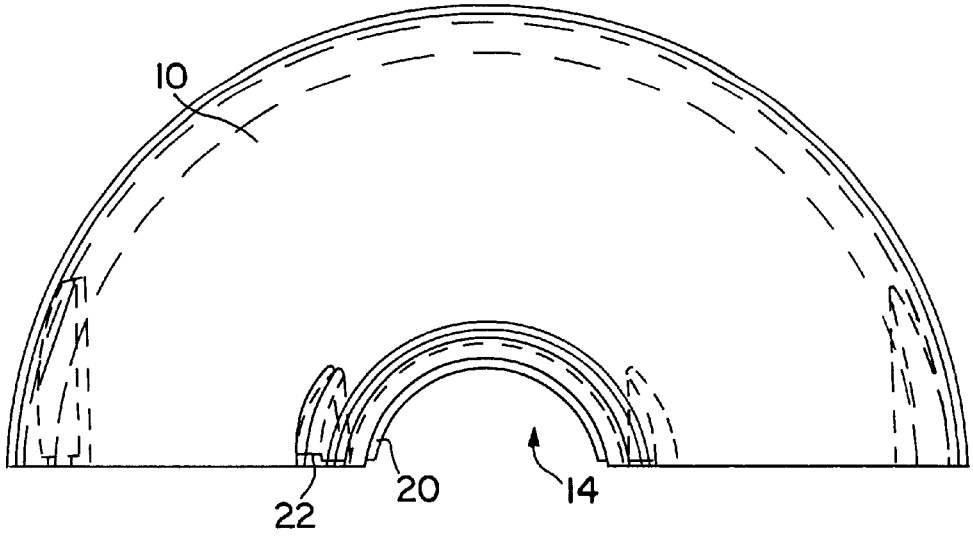
FIG. 3 shows a top view of the base member of FIGS. 1 and 2.
Figure 4:
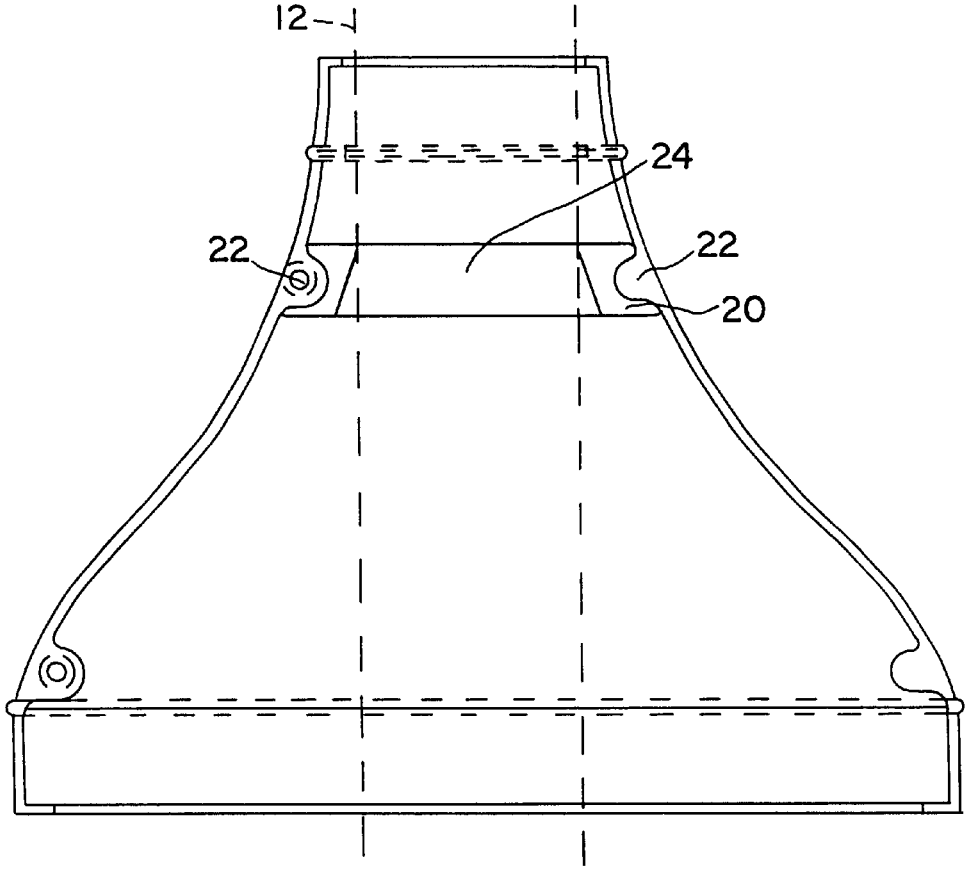
FIG. 4 shows the inside structure of the base member of FIGS. 1 and 2, with a portion of a utility pole shown in phantom.

The present invention includes a resilient gripper gasket adjacent the top of the base. As illustrated in FIGS. 1 and 4, one gasket member 20 fits within each base member 10, adjacent the position for screw mounts 22. The outside surfaces of the gasket members 20 are preferably formed to conform to the inside surface of the base members 10. As particularly shown in FIG. 4, the inside surface 24 of the gasket members 20 is angled with respect to the vertical, such that a trunco-conical opening is formed in the center of the gasket upon assembly.

The gasket members 20 are preferably made of neoprene, although almost any durable resilient material can be used. The gasket members 20 can be fixed into position within the base by means of glue or pressure sensitive adhesive. The adhesive can be applied to the outside surface of the gasket and covered with a tape (not shown) for protection until use. The tape can then be removed to expose the adhesive and the gasket member 20 can be fixed within the split base half 10.

The angled internal surface 24 of the gasket performs (at least) two functions that are desirable. First, the base unit can be assembled at any position along the pole and slid down the pole to its desired covering position. Secondly, the gasket will resist the sliding of the assembled base unit up the pole due to the added frictional forces created by the restricted end of the gasket.

Figure 5:
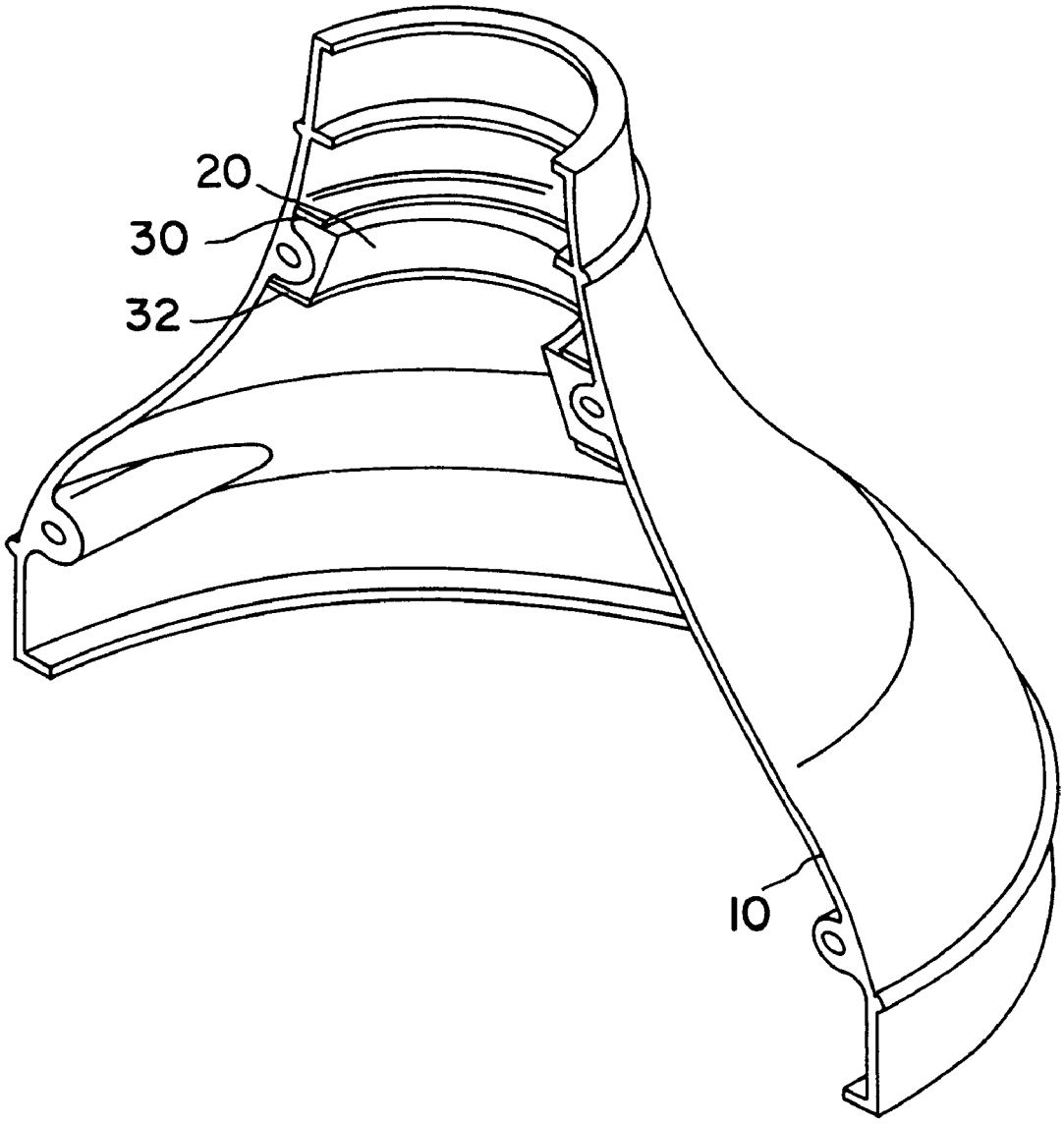
FIG. 5 is a view similar to FIG. 1 of one half or member of a second embodiment of a split base for a utility pole as is contemplated by the present invention.

As illustrated in FIG. 5, in a second embodiment of the invention upper and lower retention ribs 30 and 32 are formed on the inside surface of the base member 10. The gasket member 20 fits closely between the ribs 30 and 32. The ribs serve to retain the gripper gasket in position under high loading conditions. The second embodiment is otherwise identical to the first embodiment shown in FIGS. 1 to 4.

The present invention may be embodied in other specific forms without departing from the spirit or essential attributes thereof and, accordingly, reference should be made to the appended claims, rather than to the foregoing specification, as indicating the scope of the invention.

What is claimed is:

1. A base cover for a utility pole, comprising:

a first base member and a second base member, each comprising one half of a base unit;

the first and second base member secured to one another to form a base unit;

the base unit having an opening at its upper end, the opening adapted to wrap around a utility pole; and a resilient gasket formed adjacent the opening and adapted to engage the pole upon assembly of the base unit and resist forced movement of the base unit up the pole, said gasket defining a trunco-conical inner opening, narrowest at the top, adapted to wrap around said utility pole.

2. A base cover to for a utility pole, comprising:

a first base member and a second base member, each comprising one half of a base unit, each said base member comprising an upper and lower retention rib;

the first and second base members secured to one another to form a base unit;

the base unit having an opening at its upper end, the opening adapted to wrap around a utility pole; and a resilient gasket fitted between said retention ribs and adapted to engage the pole upon assembly of the base unit and resist forced movement of the base unit up the pole.

3. A method of covering the base of a utility pole, comprising:

providing a first base member and a second base member, each adapted to form one half of a base unit having an opening at its upper end, the opening adapted to wrap around a utility pole, each said base member having a resilient gasket member adjacent the opening, said gasket members adapted to form, upon assembly of the base unit, a gasket that engages the pole and, the gasket defining a trunco-conical inner opening, narrowest at the top, for receiving said pole and providing greater resistance to forced movement of the base unit up the pole than to movement of the base unit down the pole;

positioning the base members on opposite sides of a utility pole such that said openings wraps around said utility pole and said resilient gasket engages said utility pole;

securing the first and second base members to one another to form a base unit; and sliding said base unit down said utility pole to a desired position.

4. A base cover for a utility pole, comprising:

a first base member and a second base member, each comprising one half of a base unit, the first and second base members secured to one another to form said base unit, the base unit being hollow and broadening from an upper towards a lower end, the base unit having an opening at its upper end, the opening adapted to wrap around a utility pole upon assembly of the base unit, and the base unit having a lower end adapted to rest on a ground surface surrounding said utility pole, a resilient gasket comprising two gasket members, each disposed within and adhesively bonded to a respective one of said base members adjacent the opening, wherein said resilient gasket defines a trunco-conical inner opening, narrowest at the top, adapted to wrap around and engage said utility pole upon assembly of the base unit and resist forced movement of the base unit up the pole, an upper and a lower retention rib formed within each said base member, wherein said resilient gasket is fitted between said retention ribs, and fasteners adapted to secure said base members to one another when said base unit is assembled.

* * * * *